United States Patent [19]

Gross

[11] 3,965,912

[45] June 29, 1976

[54] COIN STORING AND TRANSFERRING APPARATUS

[75] Inventor: Erwin Gross, Bruchsal, Germany

[73] Assignee: Standardwerk Eugen Reis GmbH, Bruchsal, Germany

[22] Filed: Aug. 19, 1974

[21] Appl. No.: 499,009

[30] Foreign Application Priority Data

Aug. 20, 1973 Germany ..... 7330284[U]
Nov. 14, 1973 Germany ..... 7340676[U]

[52] U.S. Cl. ..... 133/1 R; 193/23; 198/113

[51] Int. Cl.[2] ..... G07D 1/00

[58] Field of Search ..... 133/3, 4, 8, 1 R; 198/113, 289, 238, 278, 31 R; 222/482, 483; 221/252; 193/23, 29

[56] References Cited

UNITED STATES PATENTS

| | | | |
|---|---|---|---|
| 603,641 | 5/1898 | Heyrock | 198/31 R |
| 771,648 | 10/1904 | Lamborn | 198/113 X |
| 861,172 | 7/1907 | Gray | 198/113 X |
| 984,353 | 2/1911 | Cummings | 198/113 X |
| 2,769,524 | 11/1956 | Rogier et al. | 133/3 R X |
| 3,168,188 | 2/1965 | Verban | 198/113 |

*Primary Examiner*—Stanley H. Tollberg
*Attorney, Agent, or Firm*—Murray Schaffer

[57] ABSTRACT

A coin storing and transfer device comprising a base open at its top and forming a box-like receiving container. An endless conveyor comprising a frame and a continuous belt is mounted having a portion within the receiving container and a portion extending upwardly above the level of the base to a remote height. That portion of the conveyor above the base is pivoted about a fulcrum extending transversely along the upper edge of the base adjacent one end. In this manner the upper portion of the conveyor is movable between its extending position and a folded position horizontally over the top of the base.

7 Claims, 6 Drawing Figures

COIN STORING AND TRANSFERRING APPARATUS

BACKGROUND OF THE INVENTION

The present invention relates to coin storage and transfer apparatus and particularly to a conveyor for feeding large numbers of coins to other machines such as a coin sorter, counter and packing machine.

In the handling of large quantities of coins, as for example in banks and other commercial establishments, combinations of machines are often ssembled, which consist of selected sorting, counting, roll stacking and roll packing machines. In particular the coin sorters and counters have a high speed and work performance which require constant refilling of their supply hoppers with a supply which in turn quickly becomes used. The hoppers of these machines are generally located high above the floor to permit the machines to take advantage of gravity in the handling of the coins. The highest of these machines, a counting machine, stands about 1.80 meters high. As the coins must thus be lifted to this height a difficult problem is found when large quantities of coins are handled.

A coin conveyor, for the foregoing purpose, is known which comprises generally a base container in the shape of a large open top box adapted to receive a large number of coins and which is provided with a conveyor belt which runs from the interior of the container in an oblique direction upwardly to a height above that of the hopper of its associated sorting or counting machine. The conveyor belt thus lifts the coins from a low level position within the receiving container to the high level hopper of the associated machine. In order to insure a continuous supply of coins to the sorting or counting machine, the low level receiving container must have a significantly larger volume than that of the hopper of the associated machine. As a result the coin conveyor of the known art is large and bulky and the exending conveyor involves a high degree of risk of injury to operators when it is necessary to move the conveyor from one coin sorting or counting machine to another.

For this reason, the frame on which the belt conveyor is mounted and supported is made of supporting members which can be disassembled and taken apart from the base container in order that the same may be more easily moved. This type of construction however has several drawbacks. The first being that the conveyor is made more complex and thus more expensive than is necessary and secondly that considerable expenditure of time and effort is needed by a trained staff for the assembly and disassembly of the conveyor each time it is moved from one sorting or counting machine to another.

It is the object of the present invention to provide a coin conveyor of the type described which avoids the drawbacks and disadvantages of the prior known constructions. It is a further object of the present invention to provide a coin conveyor of the type described which is simpler in construction and more economicial to manufacture and use than those of the known prior art.

It is a further object of the present invention to provide a coin conveyor of the type described having an extending conveyor which does not require assembly or disassembly each time it is moved.

It is a further object of the present invention to provide a coin conveyor of the type described having an extending conveyor frame which may be easily and simply folded over a base container so as to form a compact easily movable unit.

The foregoing objects, other objects, and numerous advantages of the present invention will be seen from the foregoing disclosure of the invention.

SUMMARY OF THE INVENTION

According to the present invention apparatus is provided for the transfer of large numbers of coins from a low level to a higher level comprising a box-like base open at its top to form a large receiving container and a continuously endless conveyor extending from within the container obliquely upwardly to a point above the base. The bottom of the receiving container slopes towards the conveyor, thus enabling the coins to slide by own weight to the conveyor. That portion of the conveyor located above the base is mounted so as to be pivotable about a fulcrum axis located at the upper edge surface of the base and at one end thereof so as to be foldable over the top of the base to rest on its upper edge surface.

The front end of the base, or the end opposite the point at which the conveyor is pivotally fulcrumed to the base, is provided with an extending ledge. The ledge serves to support the conveyor, which has been folded over the base and also serves as a supporting platform on which money bags, coins, and the like can be held, and which enables the coins to be poured into the receiving container. The conveyor comprises a frame or rail support over which an endless belt-type conveyor surface is entrained. Suitable drive rollers and drive means are located within the base and a diversionary roller is located at the upper end of the frame. A transfer mechanism or head is located at the upper end of the frame and includes guide chutes which may be angularly positioned to divert the coins from the end of the belt into the associated sorting and counting machine.

Inside the base, i.e. in the coin receiving container, the conveyor belt is provided with a cover so that the coins moving on the belt will be undisturbed in their travel by contact with the remaining coins in the conveyor. The cover is spaced from the bottom of the receiving container so as to provide an inlet slot adjacent the end of the belt. The cover is also supplied with an adjustable slide which may be selectively positioned so as to vary the opening of the inlet slot. The opening of the inlet slot may thus be selectively adjusted by moving the slide and fixing it in particular positions with regard to the size of the coins being conveyed.

In order to insure the regular passage of coins through the inlet slot onto the conveyor belt and prevent the jamming of the inlet slot the bottom of the coneyor is provided with a corrugated, wavy or rippled edge adjacent the conveyor belt. Preferably the corrugated edge is formed by a series of triangular prisms having surfaces which rise and fall with respect to each other. The interaction of the continuously movable belt with the coins passing over the corrugated edges thus keep the coins in constant motion at the transfer point onto the belt even if the receiving container is completely full. The delivery of the coins to the conveyor belt takes place witout interruption and even the final coin is reliably delivered. As a result of this construction the use of feed rollers, bridging belts and the like to insure the delivery of the coins to the conveyor belt are not necessary.

In a further improvement, the transfer point at the upper end of the conveyor is provided with two transfer chutes which are removably or detachably secured to the conveyor frame and are angularly movable with respect to each other so that they may be precisely positioned with respect to a pair of sorting and counting machines. Each of the transfer chutes are trough-like in shape and have a bottom plate which is movable and slidable axially along the bottom of the chute. The movable plate can be secured in a position completely blocking or at least partially blocking the entrance from the conveyor to the opposite or associated chute. The transfer of the coins can thus be adjusted to one operating point or to two operating points, i.e. sorting and counting machines. Thus the flow of coins can be adjusted to different quantities for each of the two machines being fed.

In another embodiment of the present invention the conveyor can be formed from two or more continuous conveyor belts which rotate and move independently of one another in the guide frame. Each of the independent conveyor belts may be provided with its own driving motor or its own independent drive transmission so that its speed may also be regulated. Preferably a separating plate or rail is arranged between each of the independent conveyor belts.

Full details of the present invention are set forth in the following description of its embodiments and are shown in the accompanying drawings.

DESCRIPTION OF THE INVENTION

Figure 1:
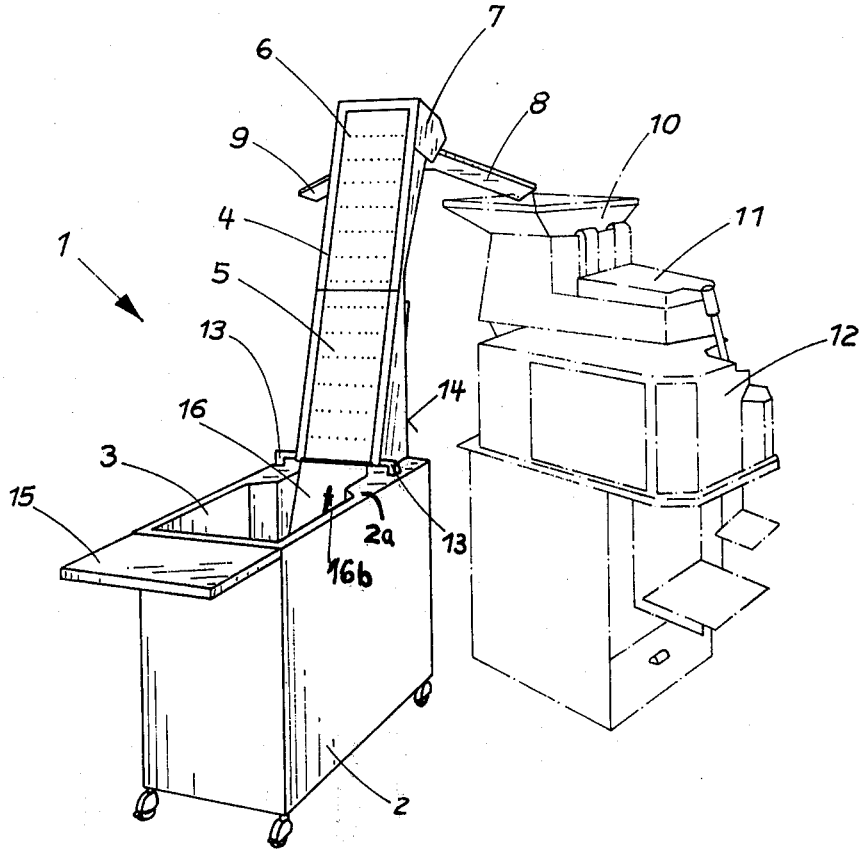
FIG. 1 is a perspective view of the apparatus of the present invention shown in operating position in conjunction with a coin counting and packing machine.

A coin storage and transfer apparatus embodying the principles of the present invention is shown in FIG. 1. The apparatus is depicted in general by the numeral 1 and comprises a box-like base 2 having wheels and the size of which permits its manual movement from place to place. The base 2 is open at its upper edge 2*a* to a height permitting the relatively easy manual delivery of coins to it. The base 2 defines an open receiving container 3, or a magazine of such a size as to hold several thousand coins of any denomination. Extending outwardly from one end of the base 2 is an obliquely upwardly directed guide frame 4 on which is located a continuously movable belt 5 having a plurality of coin engaging and receiving pins 6. The frame 4 terminates at its upper end in a transfer head 7 which overlies the end of the belt 5. Removably attached to the head 7 so as to be adjustably positioned in angular relationship with each other are a pair of chutes 8 and 9 which are adapted to feed coins falling off the end of the belt into a hopper 10, of for example a counting machine 11 wherein the coins are counted, stacked and eventually packaged in a packaging mechanism 12 into a conventional roll.

The guide frame 4 is generally formed of a pair of parallel rails 4a having a transverse roller at its upper end supporting the belt 5 and one or more transverse supports or rollers extending transversely from rail to rail between the upper and lower runs of the conveyor. That portion of the guide frame 4 extending above the upper surface 2a of the base is separately formed and is pivotally mounted near the rear end of the base 2 by a suitable hinge 13 which is secured to the upper edge surface 2*a* of the base. Suitable bracket arms 14 are fixed to the frame 4 and are adapted to rest at their lower ends on the upper surface of the edge 2*a* so as to maintain the frame 4 in the oblique position as seen in FIG. 1. Extending in the plane of the upper edge surface 2*a*, at the forward end of the base, is a ledge 15 which extends outwardly from the base and which serves as a platform for money bags or the like during the manual delivery of coins.

Figure 2:
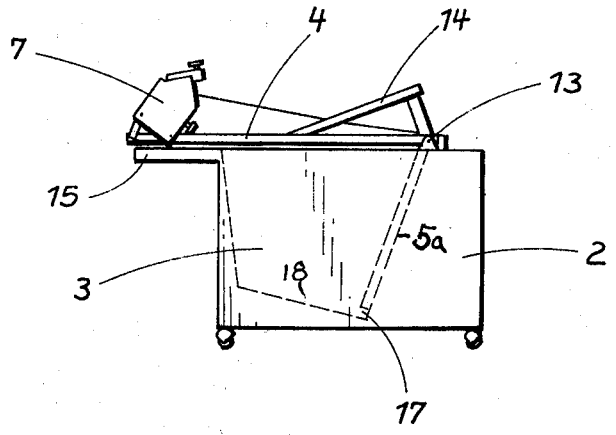
FIG. 2 is a side view of the apparatus of the present invention, according to FIG. 1, shown in its folded movable position.

As seen in FIG. 2, the frame 4 may be pivoted about the axis of the hinge 13 so that it folds forwardly downwardly onto the upper surface 2*a* and assumes a horizontal position resting upon that surface where the transfer head 7 overlies the ledge 15. The dimension of the base 2 and that of the frame 4, is chosen such that a compact unit is obtained when the frame lies in the horizontal position. In this position the frame lies well within the peripheral dimensions of the base. Suitable handle means, as well as locking means, can be provided to facilitate the folding and unfolding operation. In the folded condition, as seen in FIG. 2 the apparatus may be easily moved from one counting machine to another and its transportation in this manner establishes very little risk of injury to the operator or to adjacent equipment. The bracket support 14 is preferably a fixed part of the frame 4 and is securely attached to it. It may be also pivoted with respect to the frame so that it too will be foldable with respect to the frame and not require separate disassembly.

Figure 3:
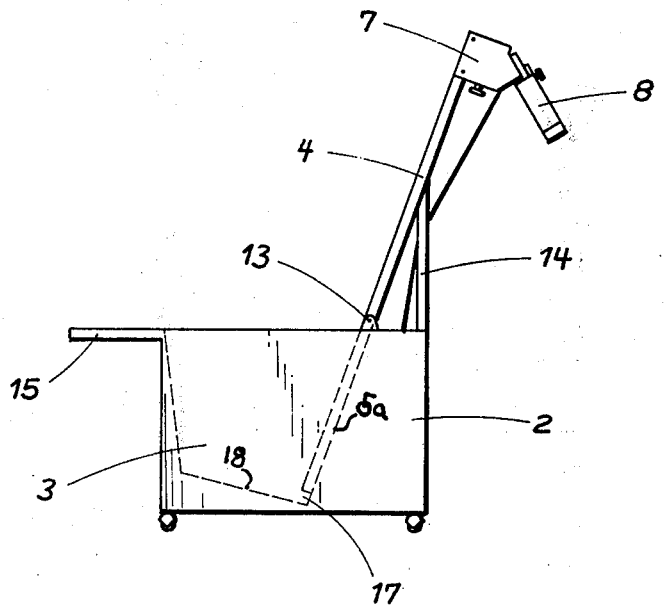
FIG. 3 shows the apparatus of the present invention in working position.
Figure 5:
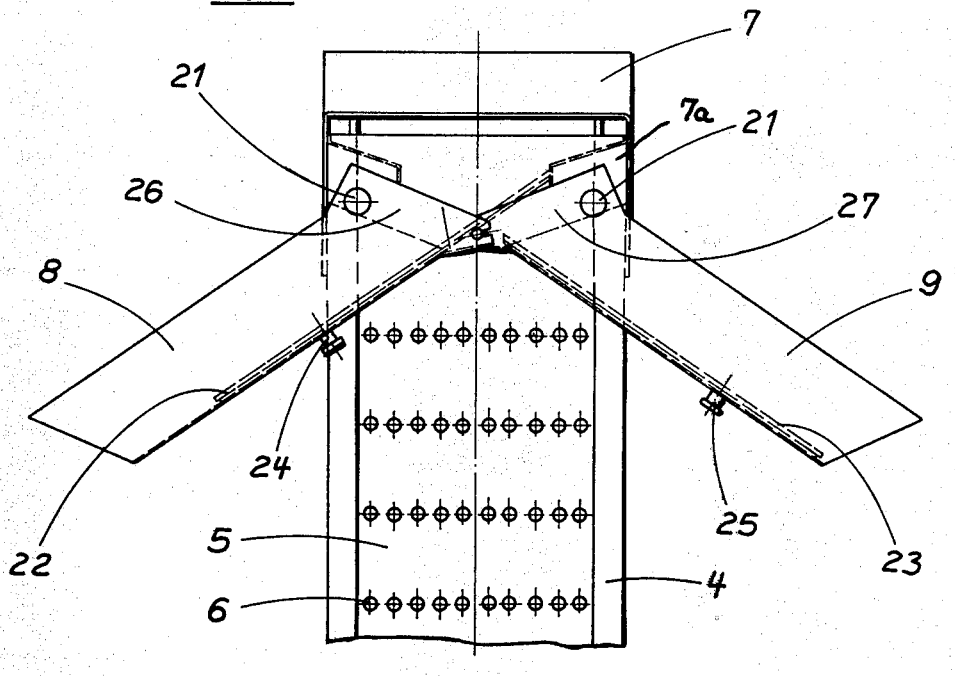
FIG. 5 is an enlarged detail view of the upper end of the conveyor showing the transfer chutes.
Figure 4:
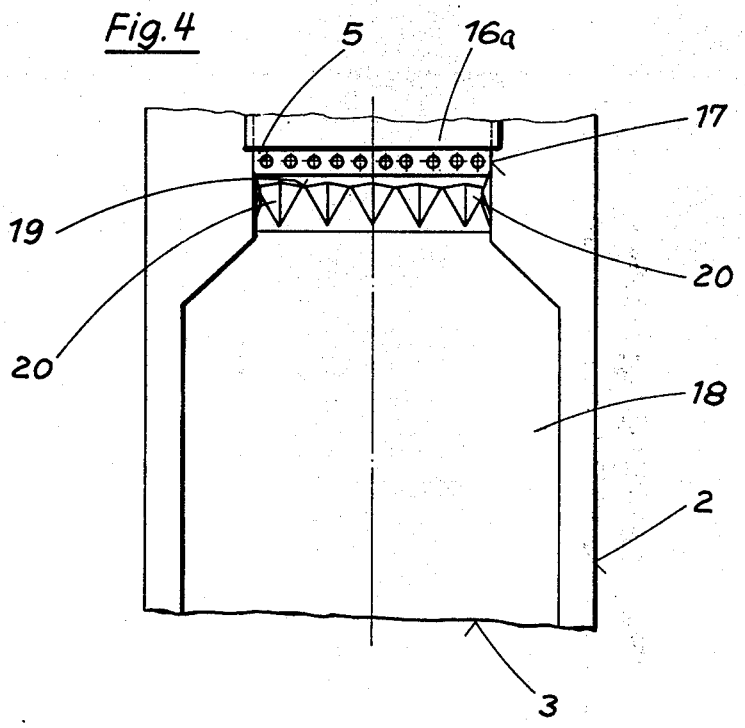
FIG. 4 is an enlarged detail view of the bottom of the receiving container at the transfer point with the conveyor.

The conveyor belt 5 is preferably a continuous endless belt of suitable flexible material such as rubber, plastic or the like adapted to run over suitable drive and guide rollers. The guide roller, drive motor and controls for operation of the belt are located within the base 2 in conventional manner and are therefore not shown in the drawings. The upper run of the belt 5 runs over the roller mounted at the upper end of the guide frame 4 and assumes a direction parallel to the oblique plane of the guide frame 4, as seen in FIG. 1. The belt extends into the base 2 in an extension of the plane of the frame 4, as indicated by the dashed line 5a seen in FIG. 2 and 3. The belt extends in this oblique plane to the bottom 18 of the base and is adapted to come into engaging contact with the coins held in the container. The container bottom is shaped and may be provided in conventional manner so that the coins flow easily toward contact with the upwardly moving conveyor belt. As seen in the drawings, the bottom 18 is sloped so that the coins slide toward the belt 5. The bottom 18 also serves as a fixed support for the coins, so that they do not weigh heavily on the belt itself. The pins 6 extend from the belt 5 in a conventional pattern so as to engage and hold the coins on the belt as the upper run of the belt moves upwardly in the conveyor frame. The rail members 4a forming the guide frame 4 provide longitudinal lips preventing the coins from falling from the conveyor.

A cover 16 is attached to the lower end of the frame 4 and extends into the container 3 spatially overlying the belt 5. The cover 16 prevents the bulk of coins in the container 3 from interfering with those coins being carried on the belt 5 in their upward direction. The cover 16 terminates at a distance from the bottom of the container 3 and thus provides an inlet slot 17 allowing the coins to be moved onto the conveyor belt 5. The cover 16 is provided with an adjustable slide portion which is movable and selectively fixed at positions spaced from the bottom 18 of the container 3 by suitable manually operable wing nut 16*b* or the like. The slide portion is positionable to vary the opening of the inlet slot 17 in accordance with the size of the coins being handled by the apparatus.

In order to insure uninterrupted passage of coins from the container 3 onto the surface of the belt 5 and to thus prevent jams of coins in the inlet slot 17, the bottom wall of the container 3 is provided with a corrugated or rippled edge 19 which in cooperation with the moving belt and the pins 6 located on the belt, causes the coins adjacent the inlet slot 17 to tumble, mix and be constantly agitated. This corrugated edge 19 is preferably formed of a series of triangular prism members 20 having surfaces which angularly rise and fall, their apex being pointed toward the bottom of the container 3 and their bases arranged in a line adjacent the surface of the belt 5. The prism members 20 may be individually secured to the base or may be provided in an elongated unitary rod-like form. This arrangement is most effective in avoiding the formation of clumps of coins or jams of the inlet slot.

At the upper end of the conveyor guide frame 4 there is located a transfer head 7 in the form of a shroud or cover for the upper roller diverting the belt 5. Extending behind the bottom run of the belt 5 are a pair of inwardly directed brackets 7*a* formed integrally with the head 7. On each of the brackets 7*a* is removably mounted a chute 8 and 9 respectively. The chutes 8 and 9 are held by bolts 21 or similar fastening means which also enable the angular adjustment of the chutes 8 and 9 with respect to each other. The chutes are generally trough like or tubular having a bottom surface over which the coins, falling from the belt 5 are adapted to move. Each of the chutes 8 and 9 is provided with a slide 22 and 23 respectively which are axially movable over their bottom surfaces. The slides 22 and 23 are adjustably positioned in fixed relationship to the chutes 8 and 9 by means of clamping bolts 24 and 25 respectively. The slides 22 and 23 are adapted to move upwardly toward the end of the belt 5 so that their positions may be selected between two extremes either completely within the chutes (as seen with regard to chute 9) or extending outwardly of the chute into the path of the adjacent chute so as to block that adjacent chute from communication with the belt 5 (as seen with regard to chute 8). The slides may be selectively positioned to also partially block the entrance of the adjacent chute. In either event the movably positioned slides 22 and 23 permit selective adjustment of the flow or delivery rate of coins from the belt 5 to one or both of the chutes depending on the requirement of the counting machine to which that chute is intended to deliver its coins.

Figure 6:
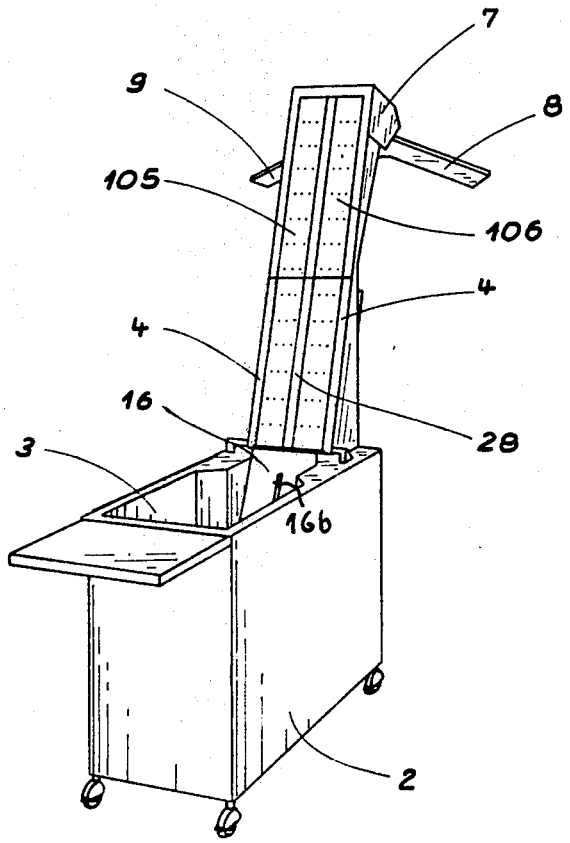
FIG. 6 is a perspective view of a second embodiment of the apparatus of the present invention showing a conveyor having two conveying belts.

In the embodiment as seen in FIG. 6, the conveyor guide frame 4 is provided with two belts 105 and 106 arranged side by side with each other. The two belts are adapted to be run independently of each other and are thus provided with separate drive motors or with independent drive transmissions. Preferably the conveyor rollers located at the upper end of the conveyor guide frame within the transfer head 7, for each of the belts 105 and 106 are freely rotatable with each other while the drive rollers supporting the belts 105 and 106, located within the base 2 are driven by separate drive motors. A center rail 28 is located between the belts 105 and 106 to thus separate the belts and the coins lying on the respective belts from intermingling with each other. The rail extends into the container 3 down to the inlet slot 17 and is divided adjacent the area of the hinge 13 so as to permit the free folding of the guide frame 4 as previously described. In other respects the apparatus as seen in FIG. 6 is similar to that shown in FIGS. 1 through 5. It will be obvious that if desired more than two belts may be used.

It will be seen from the foregoing that the folding of the guide frame 4 is simple and easy because the frame folds inwardly over the base 2. As a result the inward movement of the belt 5 doubles over without being stretched or distorted and without the necessity of its being disassembled. The guide frame 4 lies on the upper edge 2a of the base 2 and its upper or transverse head portion 7 rests securely on the extending ledge 15. When the guide frame 4 is opened the belt 5 resumes its proper shape and tautness without any need for manual reassembly. The ability to angularly position the chutes 8 and 9 further enables the folding of the assembly into compact form. The conveyor frame 4 may be made from unitary side rails extending the full distance from the base to its desired height or it may be made of telescoping rail members which are slidable one into each other so that the height of the frame and its conveyor may be adjusted in its extended position.

The special advantages of the apparatus according to the present invention reside in its simple construction and above all in the fact that all of its parts, which in its working state normally protrude beyond the box-like dimensions of the base, can be shifted and folded with the use of a single hand and thus disassembled as a whole into a compact easily transportable unit in which there are no bulky extending parts protruding from the superstructure.

Further advantages are derived from the improved transfer of the coins from the bottom of the receiving container onto the conveyor belt. The corrugated or prism-like members arranged adjacent the edge of the container in opposition to the belt 5 insures the uninterrupted delivery of the coins from the magazine onto the conveyor belt and therefore the full distribution of the coins. In like manner the transfer or diversion chutes are also advantageously structured. Because they can be easily fitted to the conveyor and removed there from they make it possible to pass the flow of coins carried upwardly by the conveyor belt in an optimal distribution to several consumer points.

It is finally an advantage to provide the apparatus of the present invention with multiple conveyor belts. In this manner a plurality of processing lines, associated with a single coin conveyor can be provided which take different quantities of coins. Each of the conveyor belts can be selectively moved at such a speed to provide coins to its associated processing line at the desired quantity independently of the operation of the adjacent belts. The quantities delivered can be increased or reduced during operation, as required for each processing line. Similarly any one processing line can be shut down while the apparatus of the present invention continues its operation and feeding of coins to other processing lines. As a result even in the event a single line breaks down or is shut down for any reason the other processing lines are not influenced and their operation is not in any manner interrupted. As a result the output of the present apparatus can be fully and economically employed.

Since various modifications and embodiments have been described herein and other numerous ones will be obvious to those skilled in the present art, it is intended that the present disclosure be taken as illustrative only and not as limiting of the invention.

What is claimed is:

1. An apparatus for storing and transporting coins comprising: a rectangular base box open on top and defining in its interior a coin receiving container; an elongated frame having a head at one end, means for pivotally securing the other end of said frame along one end of the top of said base box and means for supporting said frame so that its head end extends upwardly at an oblique angle from the interior of said container to a level above said base box, a conveyor provided with transverse parallel arrays of coin entraining pins protruding therefrom, said conveyor comprising a pair of parallel endless belts supported by said frame, each belt extending between lower roller means mounted within said base box and outer roller means mounted at the head end of said frame and provided with means for selectively driving said lower roller means to independently move said belts, said container having a bottom sloping toward said conveyor to direct the coins thereon, said bottom being provided adjacent said conveyor with a corrugated edge cooperating with said conveyor to agitate the coins, said frame being arranged to pivot together with the section of said conveyor supported thereby about a fulcrum to enable said frame and the section of the conveyor supported thereby to fold over said base box in a plane common to that of the top of said base box covering its open top.

2. The apparatus according to claim 1 including a cover overlying the portion of said conveyor within said container, said cover having an end spaced from the bottom of said container to define a coin flow inlet slot to said conveyor.

3. The apparatus according to claim 2 including means for adjustably positioning the end of said cover from the bottom of said container to provide a selectively variably inlet slot.

4. The apparatus according to claim 1 wherein said corrugated edge comprises a plurality of prism-like members arranged adjacent each other having axially and transverse sloping edges.

5. An apparatus for storing and transporting coins comprising: a rectangular base box open on top and defining in its interior a coin receiving container; an elongated frame having a head at one end, means for pivotally securing the other end of said frame along one end of the top of said base box and means for supporting said frame so that its head end extends upwardly at an oblique angle from the interior of said container to a level above said base box, a conveyor provided with transverse parallel arrays of coin entraining pins protruding therefrom, said conveyor comprising a pair of parallel endless belts supported by said frame, each belt extending between lower roller means mounted within said base box and outer roller means mounted at the head end of said frame and provided with means for selectively driving said lower roller means to independently move said belts, said container having a bottom sloping toward said conveyor to direct the coins thereon, a pair of chutes mounted to the head of said frame for directing coins away therefrom, said chutes being pivotally mounted to be positioned at selected angles with respect to each other, said frame being arranged to pivot together with the section of said conveyor supported thereby about a fulcrum to enable said frame and the section of the conveyor supported thereby to fold over said base box in a plane common to that of the top of said base box covering its open top.

6. The apparatus according to claim 5 including a ledge mounted on said base at the end opposite to that on which said frame and conveyor are located and in common plane to that of the upper edge surface of said base box and extending from said base a distance substantially corresponding to the length of the outside portion of said frame and said conveyor foldable over said base box.

7. The apparatus according to claim 5 wherein said chutes are trough-like and are arranged to have one end of one chute adjacent the corresponding edge of the other chute at an angle to each other, each of said chutes having an adjustable bottom movable toward the entrance of the other chute, and means for positioning said movable bottom at selected positions to variably block the entrance of the other chute.

* * * * *